US011654344B2

(12) United States Patent
Farrell

(10) Patent No.: US 11,654,344 B2
(45) Date of Patent: May 23, 2023

(54) SKI CLIMBING ATTACHMENT SYSTEMS AND METHODS

(71) Applicant: Michael Farrell, Oak Creek, CO (US)

(72) Inventor: Michael Farrell, Oak Creek, CO (US)

( * ) Notice: Subject to any disclaimer, the term of this patent is extended or adjusted under 35 U.S.C. 154(b) by 0 days.

(21) Appl. No.: 17/674,210

(22) Filed: Feb. 17, 2022

(65) Prior Publication Data

US 2022/0274004 A1 Sep. 1, 2022

Related U.S. Application Data

(60) Provisional application No. 63/154,201, filed on Feb. 26, 2021.

(51) Int. Cl.
*A63C 7/02* (2006.01)
*A63C 7/04* (2006.01)

(52) U.S. Cl.
CPC . *A63C 7/02* (2013.01); *A63C 7/04* (2013.01)

(58) Field of Classification Search
CPC ..... A63C 7/02; A63C 7/04; A63C 2201/06
See application file for complete search history.

(56) References Cited

U.S. PATENT DOCUMENTS

| | | | | | |
|---|---|---|---|---|---|
| 1,783,833 | A * | 12/1930 | Elsner | A63C 7/02 | 280/604 |
| 1,989,377 | A * | 1/1935 | Osborn | A63C 7/02 | 280/604 |
| 2,287,252 | A * | 6/1942 | Kaufmann | A63C 7/02 | 280/604 |
| 2,326,802 | A * | 8/1943 | Robinson | A63C 7/04 | 280/604 |
| 4,544,179 | A | 10/1985 | Boudreau | | |
| 5,398,957 | A * | 3/1995 | Leighton | A63C 13/00 | 280/600 |
| 6,837,512 | B2 | 1/2005 | Long | | |
| 8,317,217 | B2 * | 11/2012 | Zemp | A63C 7/02 | 280/809 |
| 9,010,797 | B2 * | 4/2015 | Elliott | A63C 7/04 | 280/604 |
| 9,067,124 | B2 | 6/2015 | Elliott | | |
| 9,993,717 | B2 * | 6/2018 | Gasparro | A63C 7/08 | |
| 10,926,157 | B2 * | 2/2021 | Mayrhofer | A63C 5/12 | |
| 11,511,178 | B2 * | 11/2022 | Daniell | A63C 7/108 | |
| 2014/0161554 | A1 * | 6/2014 | Ewasko | B60P 3/079 | 410/2 |

FOREIGN PATENT DOCUMENTS

| | | | | |
|---|---|---|---|---|
| AT | 244822 B * | 1/1996 | | |
| AT | 12128 U1 * | 9/2011 | | A63C 7/08 |
| CH | 395832 A * | 7/1965 | | |
| CH | 710338 A2 * | 5/2016 | | A63C 7/04 |

* cited by examiner

*Primary Examiner* — James A Shriver, II
*Assistant Examiner* — Michael T. Walsh
(74) *Attorney, Agent, or Firm* — Acuity IP, LLC; Nathan S. Cassell

(57) ABSTRACT

Systems and methods for attaching with a ski to provide improved traction while climbing snowy grades. Exemplary climbing track assemblies can include an attachment to the bottom of a ski that improves traction for hiking or climbing uphill. Assemblies can also include an under-binding bracket, which is mounted under the toe-piece binding of the ski which allows the device to be securely fastened. Assemblies may further include a shim, provided as a small plate mounted under the heel-piece binding, which operates to keep the binding level.

20 Claims, 7 Drawing Sheets

SKI CLIMBING ATTACHMENT SYSTEMS AND METHODS

CROSS-REFERENCES TO RELATED APPLICATIONS

This application claims the benefit of U.S. Provisional Patent Application No. 63/154,201 filed Feb. 26, 2021, the disclosure of which is incorporated herein by reference.

BACKGROUND OF THE INVENTION

Embodiments of the present invention relate to the field of skis, and in particular embodiments, to ski climbing mechanisms.

Backcountry skiers and snowboarders employ different equipment and techniques to enjoy the rush of being propelled downhill by gravity through the fresh powdery snow. There are three main types of backcountry equipment, including telemark gear, alpine touring (A.T.) gear, and splitboard snowboarding gear.

Telemark skiers have a flexible boot with a binding that holds only the toe of the boot firmly. This is why it is also referred to as free heel skiing. The method of skiing is quite different from typical alpine skiing, but is equally enjoyable. The main advantage of telemark skiing in the backcountry is that the flexible boot and free heal allow for the skier to walk and climb with a more natural, and comfortable motion. The telemark skier uses equipment that favors hiking, and alters the downhill skiing technique to compensate for the equipment. When hiking, the skier is able to push one ski forward and step down on the leading ski while the boot attached to the trailing ski is allowed to pivot on the toe, and the heel is allowed to angle upward. Then the skier pulls the trailing ski forward and pushes it in front of their body. This ski now becomes the leading ski, the skier now steps down on this ski, and the toe flexes and the heel tilts up on the trailing ski, and the process is repeated. The hiking or climbing is relatively comfortable, provided that the skier can get traction on the slippery snow.

Alpine touring or A.T. skiers utilize equipment similar to regular alpine skiing gear, in that the boot is held rigidly on the ski by both the toe-piece and the heel-piece, with two main differences. First, the heel-piece can be released from the boot when ready to hike. Second, the toe piece has a set of laterally aligned pins that hold the boot, but will allow the boot to pivot upward when hiking. When in hiking mode, the boot is loosened and the motion and comfort of the hiking is very similar to that of the telemark skier. When ready to go downhill, skier then locks the heel piece to the boot and skis downhill in a typical alpine manner. The A.T. skier uses equipment that favors downhill skiing, and alters the bindings and boots to compensate while hiking.

Splitboard snowboarders utilize a snowboard and binding system that allows the snowboard to be unclipped and effectively be transformed into two skis. The bindings are also transformed in their position to be more suitable to hiking. The splitboard rider uses a completely different type of equipment and technique to go downhill, and yet effectively morphs into a skier for the hiking mode.

A noticeable common denominator is that all three methods employ a similar means of hiking uphill. Another commonality is that all three need to improve traction on the slippery snow to achieve a comfortable and practical means of hiking. Now the most common form of increasing traction on slippery snow is by the use of climbing skins. These are basically a fabric that has a bristle pile that is slanted in one direction. The fabric is adhered to the base of the ski with the pile slanted toward the rear of the ski. This allows some glide in the forward motion, and the pile bites into the snow for traction when hiking. The climbing skins are clipped to the front and back of the ski, and there is an adhesive coating on the surface that contacts the base of the ski. This adhesive in a sense weakly glues the skin to the ski base helping the skier keep the skin from sliding laterally off of the ski. These climbing skins work very well, however, they have a couple of drawbacks. First, they are very time consuming to put on and take off. The skier usually must take their skis off in order to attach and remove them. Because of the adhesive on the climbing skins, they must be handled carefully. Climbing skins usually have a fabric strip to be placed between the adhesive sides to keep them from sticking together too tightly, this requires the skier to allow another interval of time to repackage them into their holding bag. Furthermore, the adhesive on the climbing skins loses its tackiness if it gets wet, or snow on it. This is not an ideal situation when considering the conditions where skiing takes place. Climbing skins work well for long treks, like a climb which takes several hours to accomplish. Where they break down is on small hikes, or on relatively small slopes where skiers can make several laps up and down, or when hiking in rolling terrain with an alternating series of uphill climbs and downhill pitches. It just becomes too cumbersome to keep taking the time required to attach and remove them.

There is another alternative, fish-scale base skis. These are skis with a center section of ski base material that is embossed with a sloping textured pattern resembling fish scales. The scale pattern slopes gently toward the back of the ski and at regular intervals abruptly drops in a ledge approximately ½ mm. of relief in a radius scale shape. This forms a surface that glides well forward, and does grip well when hiking moderate to low gradient slopes. The drawback of fish scale skis is that they can't be patterned too aggressively or they lose performance, so they are usually only used on moderate slopes. Also, they work well on dry powdery snow conditions, but when encountering packed or firm snow conditions they tend to chatter and are slow because of the increased friction from the textured base. When skiing, fish scale skis do not perform as well as smooth skis, as they are slower due to the increased drag produced from the uneven base surface. The effect is even more pronounced on firmer snow, such as sun baked or dense wind blown snow. Fish scale skis are not recommended for ski resort use on packed ski runs. Because of this, skiers who ski at ski resorts, and also in the backcountry, are usually inclined to have to purchase more than one pair of skis in order to maintain good ski performance. This is an expensive alternative.

In sum, ski climbing mechanisms are used by skiers to help them climb up hills, mountains, and other inclines. A variety of ski mechanisms are used for such purposes, including climbing skins, fish scale bases, and the like. Although such mechanisms are useful in many situations, still further improvements are desired. Embodiments of the present invention provide solutions to at least some of these outstanding needs.

BRIEF SUMMARY OF THE INVENTION

Embodiments of the present invention include ski climbing attachment systems and methods that can be used to help skiers climb up grades. Ski climbing solutions provided herein can eliminate time constraints and moisture problems associated with full length climbing skins.

In one aspect, embodiments of the present invention encompass ski climbing attachment devices that can be coupled with skis. A ski climbing attachment system can include a means for contacting and gripping a snow surface, and a means for coupling with a ski. In some cases, a ski climbing attachment system for coupling with a ski can include a climbing track assembly and an under-binding bracket assembly. A climbing track assembly can include a base and a fastening mechanism. The base can include an upper surface configured to engage a bottom surface of the ski, a right sidewall configured to engage a right side of the ski, a left sidewall configured to engage a left side of the ski, and a bottom surface having a friction mechanism configured to grip a snowy surface. The fastening mechanism can be in pivoting engagement with the base. The under-binding bracket assembly can include a bracket and a catch mechanism. The bracket can be configured to be engaged with a top surface of the ski, and the catch mechanism can be configured to engage the fastening mechanism of the climbing track assembly.

In some cases, the fastening mechanism includes a first fastening member and a second fastening member. The first fastening member can be in pivoting engagement with the left side of the base and the second fastening member can be in pivoting engagement with the right side of the base. In some cases, the first fastening member is in pivoting engagement with the left side of the base via a first wire that is coupled with the left side of the base, and the second fastening member is in pivoting engagement with the right side of the base via a second wire that is coupled with the right side of the base. In some cases, the first fastening member includes a buckle, and the second fastening member includes a ladder strap. In some cases, the catch mechanism of the under-binding bracket assembly includes a first tab and a second tab (e.g. extending perpendicularly from a bracket of the under-binding bracket assembly). In some cases, the first tab and the second tab define a channel therebetween, and the channel is configured to receive the fastening mechanism of the climbing track assembly. In some cases, the under-binding bracket assembly further includes a riser block configured to engage the fastening mechanism of the climbing track assembly. In some cases, the riser block includes a compressible material. In some cases, the friction mechanism includes a slant-fiber pile fabric. In some cases, the friction mechanism includes an embossed one-directional pattern. In some cases, the embossed one-directional pattern includes a fish scale pattern.

In another aspect, embodiments of the present invention encompass methods of engaging a ski climbing attachment system with a ski. Exemplary methods include engaging a climbing track assembly with the ski and engaging an under-binding bracket assembly with the ski. The climbing track assembly can include a base and a fastening mechanism. The base can include an upper surface configured to engage a bottom surface of the ski, a right sidewall configured to engage a right side of the ski, a left sidewall configured to engage a left side of the ski, and a bottom surface having a friction mechanism configured to grip a snowy surface. The fastening mechanism can be in pivoting engagement with the base. The under-binding bracket assembly can include a bracket and a catch mechanism. The bracket can be configured to be engaged with a top surface of the ski. The catch mechanism can be configured to engage the fastening mechanism of the climbing track assembly.

In some cases, the fastening mechanism includes a first fastening member and a second fastening member. In some cases, the first fastening member is in pivoting engagement with the left side of the base and the second fastening member is in pivoting engagement with the right side of the base. In some cases, the first fastening member is in pivoting engagement with the left side of the base via a first wire that is coupled with the left side of the base, and the second fastening member is in pivoting engagement with the right side of the base via a second wire that is coupled with the right side of the base. In some cases, the first fastening member includes a buckle, and the second fastening member includes a ladder strap (e.g. for ratcheted engagement with the buckle). In some cases, the catch mechanism of the under-binding bracket assembly includes a first tab and a second tab. In some cases, the first tab and the second tab define a channel therebetween. In some cases, the channel is configured to receive the fastening mechanism of the climbing track assembly. In some cases, the under-binding bracket assembly further includes a riser block configured to engage the fastening mechanism of the climbing track assembly. In some cases, the riser block includes a compressible material. In some cases, the friction mechanism includes a slant-fiber pile fabric or an embossed one-directional pattern.

DETAILED DESCRIPTION OF THE INVENTION

All illustrations of the drawings are to be describing selected embodiments of the present invention and are not intended to limit the scope of the present invention. All references of user or users pertain to either individual or individuals who would utilize embodiments of the present invention.

Embodiments of the present invention provide systems and methods for traction enhancement, which can be implemented in various backcountry skiing pursuits, for example.

Exemplary embodiments disclosed herein are well suited for use in backcountry skiing, providing uphill traction devices that are easy to install and remove, and that do not compromise overall ski performance. In some cases, embodiments can be used in combination with a ski, for example a backcountry ski. In some cases, embodiments can be used in combination with a snowboard, for example a splitboard snowboard. A splitboard is a snowboard which splits into two halves, and the halves can effectively become skis for travelling uphill, downhill, or touring. In some instances, a user will use the halves as skis while climbing uphill, and then reassemble the two halves by coupling them together to form a snowboard, and then ride the snowboard downhill, for example through untracked powder. Because the splitboard halves are effectively used as skis, the term "ski" as used herein encompasses a splitboard half. Embodiments of the present invention encompass ski climbing attachment systems and methods.

Figure 1:
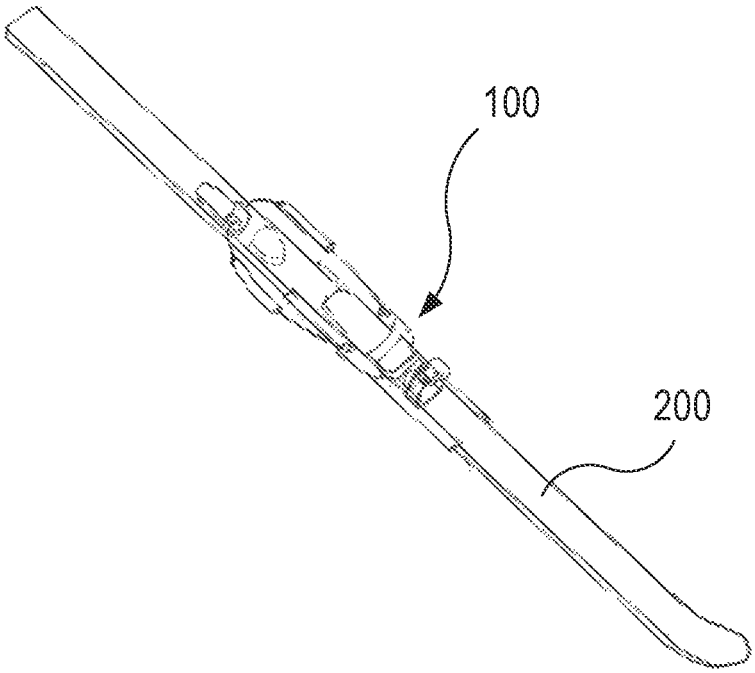
FIG. 1 illustrates aspects of a ski climbing attachment system, according to embodiments of the present invention.
Figure 2:
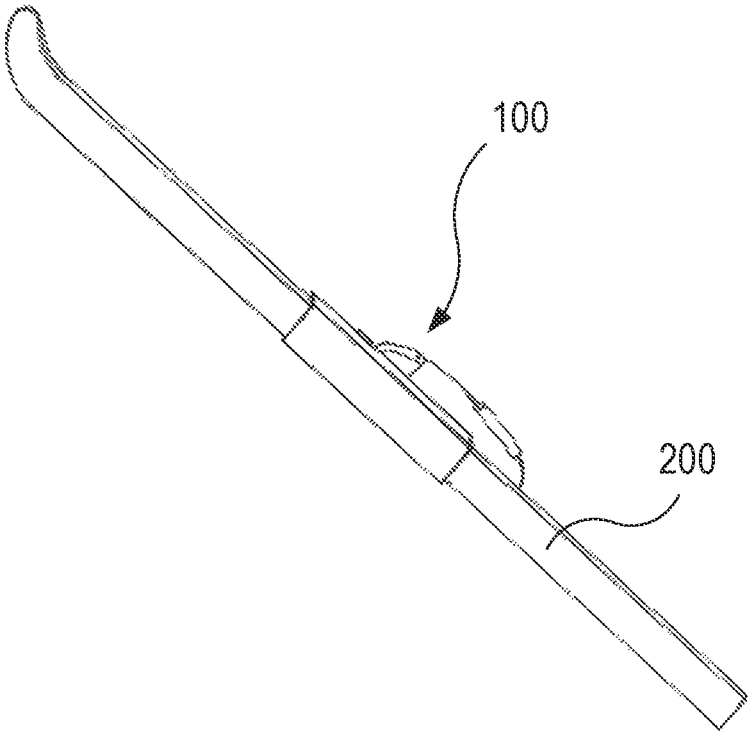
FIG. 2 illustrates aspects of a ski climbing attachment system, according to embodiments of the present invention.

Turning now to the drawings, the upper perspective view of FIG. 1 depicts aspects of a ski climbing attachment system, according to embodiments of the present invention. As shown here, the ski climbing attachment system 100 is coupled with a ski 200. Relatedly, the lower perspective view of FIG. 2 depicts aspects of a ski climbing attachment system, according to embodiments of the present invention. As shown here, the ski climbing attachment system 100 is coupled with a ski 200.

Figure 3:
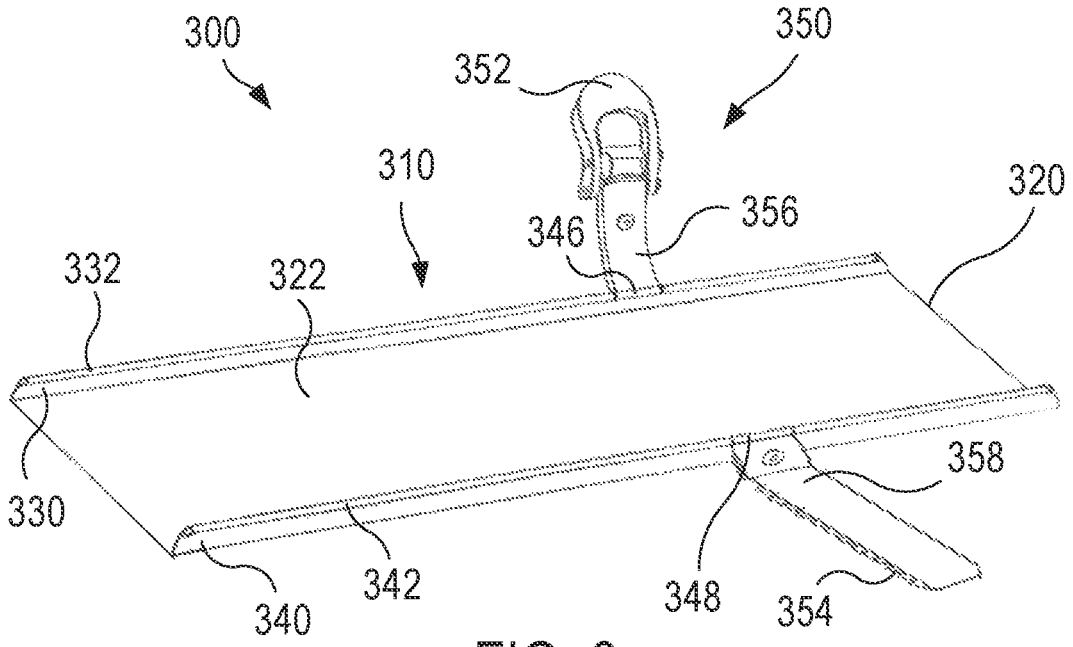
FIG. 3 illustrates aspects of a climbing track assembly of a ski climbing attachment system, according to embodiments of the present invention.

FIG. 3 provides an upper perspective view of a climbing track assembly 300 of a ski climbing attachment system, according to embodiments of the present invention. A climbing track assembly 300 can be provided as an attachment to the bottom of a ski and that improves traction for hiking or climbing uphill. As shown here, a climbing track assembly 300 can include a base 310 having an upper surface 322 of a central portion 320 and two sidewalls 330, 340. A fastening mechanism 350 is coupled with the base 310. As shown here, fastening mechanism 350 can include a first fastening member 352 and a second fastening member 354. In some cases, fastening members may include buckle or clasp members. Such fastening members can be used to fasten two straps 356, 358 together, so that the straps are held together in a secure and adjustable manner.

The base 310 of the climbing track assembly 300 can be made of various gauges of sheet metal, of various types and alloys of metal, or of various types and densities of plastic or synthetic materials. The traction device or climbing track assembly 300 can have a cross section of a flattened U shape, with a base 310 having a central section 320 and relatively low upturned sidewalls 330, 340. In some embodiments, the sidewalls 330, 340 are upturned at right angles to the track base central section 320. The sidewalls 330, 340 can provide stiffness to the track base 310, as well as functioning to keep the track base 310 from becoming mis-aligned with the ski when encountering lateral forces, which may occur when hiking on a sidehill. Each sidewall 330, 340 can also incorporate a stiff wire 332, 342 which can be hemmed over or molded into the top of the sidewall. This wire edge can function to increase stiffness of the track base, and the wire edge can also provide a hinge pin 346, 348 for the fastening mechanism 350 (e.g. strap 356 and strap 358 to be attached).

Figure 5:
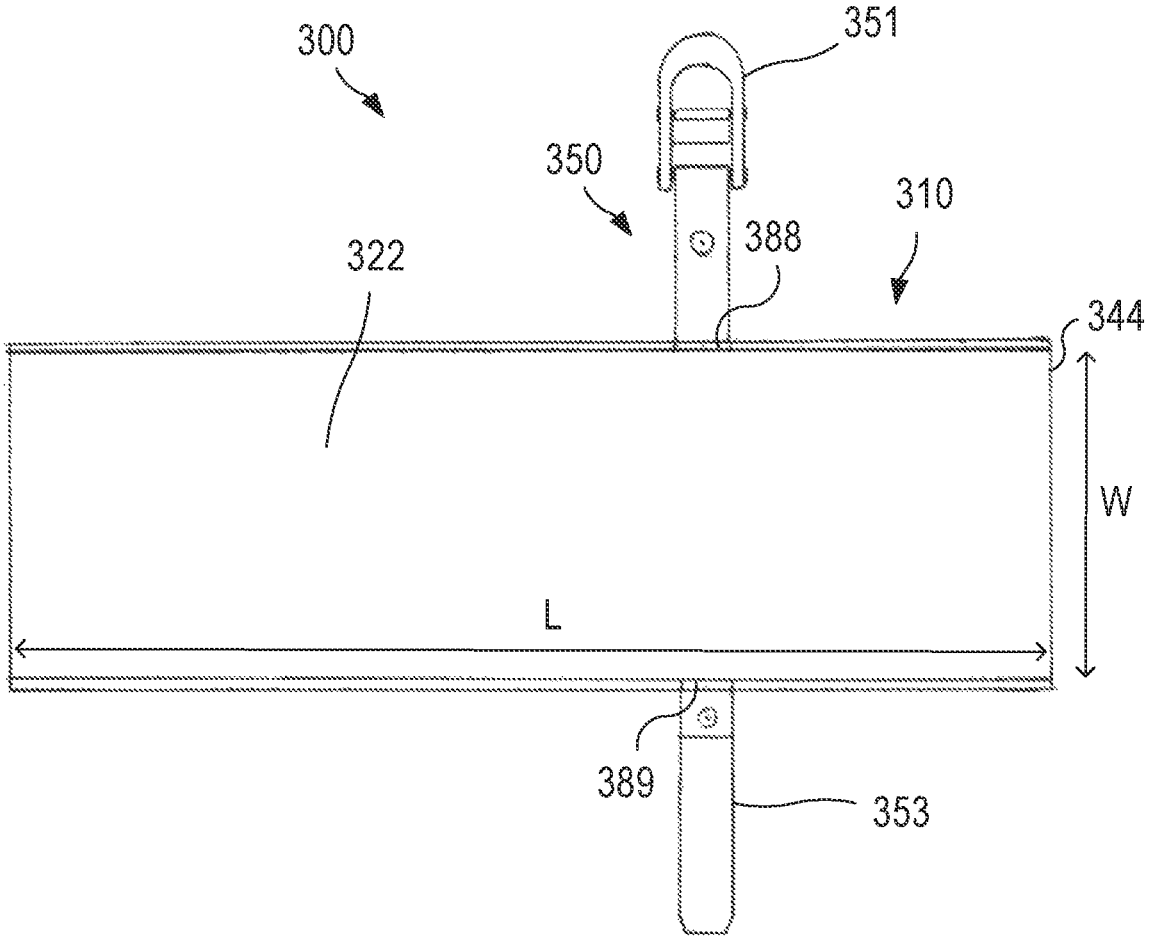
FIG. 5 illustrates aspects of a climbing track assembly of a ski climbing attachment system, according to embodiments of the present invention.

In some cases, the base 310 is provided with a flat central section 320 and two 90 degree upturned sides 330, 340. In some cases, the base 310 can be made from sheet metal, molded plastic, or synthetic composite materials. In some case, the base 310 can have a length L (as depicted in FIG. 5) having a value within a range from about 14 inches to about 16 inches. In some cases, length L is greater than 16 inches. In some cases, length L is selected to as to provide for easy portability in a day-pack. In some cases, a base 310 have a length L of a greater length can operate to provide increased traction for more aggressive skiers.

In some embodiments, fastener mechanisms can include, without limitation, a cam style latch or buckle on one side of the track base, and an adjustable strap (e.g. a ladder strap) on the other side. Either or both of the latch/buckle and the adjustable strap can be coupled with the track base via a hinge or hinged arm mechanism. Advantageously, the fastener mechanism can operate to achieve enough leverage when latched to form a very firm attachment between the track base 310 and the ski.

Figure 4:
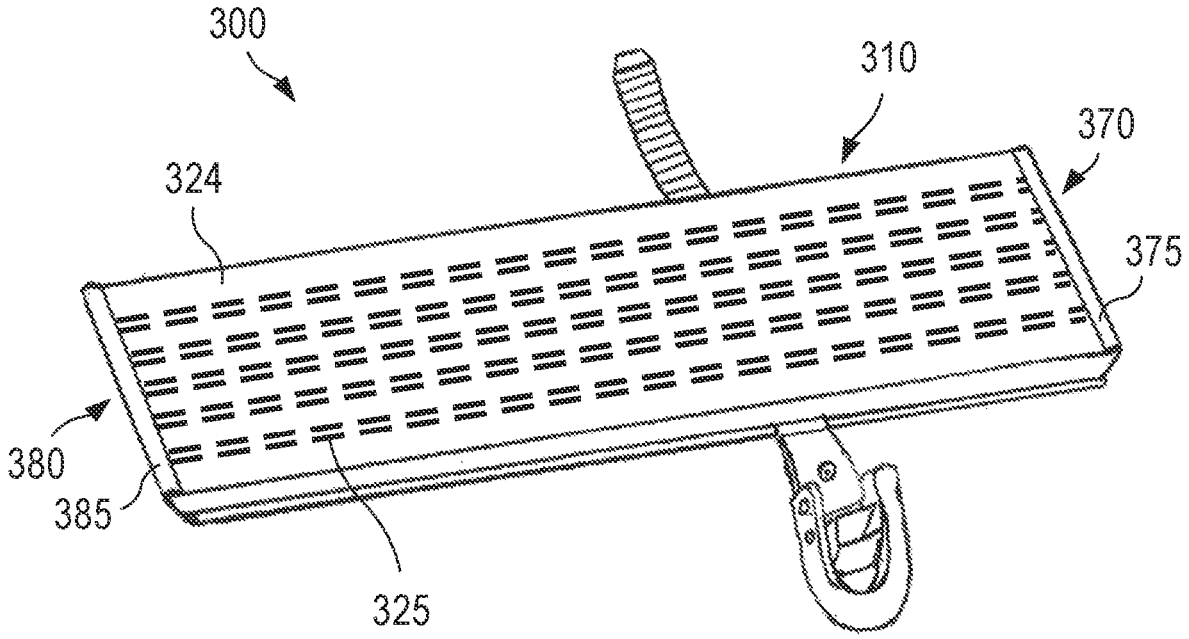
FIG. 4 illustrates aspects of a climbing track assembly of a ski climbing attachment system, according to embodiments of the present invention.

FIG. 4 provides a lower perspective view of a climbing track assembly 300 of a ski climbing attachment system, according to embodiments of the present invention. In use, a lower surface 324 of the central portion 320 of the base 310 contacts the snow surface. The track base 310 can include any of a variety of materials, such as metal or plastic. In some cases, the lower surface 324 includes or is attached with a friction mechanism 325 such as a texture or surface relief feature that increases friction between the base 310 and the snow. In some cases, the lower surface 324 of the track base which contacts the snow surface has a material 325 adhered thereto that increases friction and therefore improves traction when hiking on or up the slippery slopes. Exemplary friction mechanisms 325 can operate to provide some amount of glide when the ski is pushed forward (e.g. glide between the ski and the snow), and grip when the ski is stepped on or user to propel the user forward or to keep the user stationary (e.g. grip between the ski and the snow). Exemplary friction aids or friction mechanisms 325 can include, without limitation, slant-fiber pile fabric, or sheet plastic material embossed with a one-directional pattern (e.g. in a fish scale pattern). In some cases, these fabrics or plastics can be adhered to the lower surface 324 of the track with adhesives, and/or can be crimpled over with a leading hem 375 (e.g. metal hem) on the leading edge 370 and a trailing hem 385 (e.g. metal hem) on the trailing edge 380 of the track base 310. In this way, it is possible to securely and permanently affix the fabric or plastic to the track base 310. In some cases, the fabric or plastic is temporarily affixed to the track base 310. The lower surface material 325 can be affixed to or crimpled to track base 310 in a variety of ways. In some cases, the crimped material or crimping feature can be either an extension of the track base 310, or it can be a material (e.g. metal or plastic) that is molded into the track base 310.

Exemplary friction aids or friction mechanisms 325 can operate to contact the snow and provide increased friction between the track base 310 and the snow. In some cases, the friction mechanism 325 can be affixed to the track base 310 via one or more crimps. In some cases, a crimp is an extension of metal track or an extension molded into plastic track. In some cases, a crimp folds over the traction material on the leading and trailing edge of track base and ensures a permanent and durable attachment. In some cases, a crimp or hem also provides for rigidity or stiffness across the base of the track base.

As shown in FIG. 5, the track base 310 can have a width W. In exemplary embodiments, the width W is selected so as to be compatible with the width of a ski. In some cases, the track width W is configured to be slightly wider than the ski width it is attached to, as long as it does not become a hindrance. In use, the upper surface 322 of the base 310 can be in contact with the ski (e.g. the base of the ski). In some cases, the upper surface 322 has a firm yet compressible material inserted and permanently adhered to the track. This padded insert can help protect the bases and edges of the skis or splitboard while attached to the track during use.

The climbing track assembly 300 can include a fastening mechanism 350 coupled with the base 310. In some cases, the fastening mechanism 350 includes a cam-style buckle 351 on one side, and an adjustable strap 353 on the other side. The style of fastener can vary and is not limited to the one style listed here. In exemplary embodiments, the fastening mechanism is configured to provide a firm attachment, and to allow the track assembly 300 to be easily installed and removed from a ski. Each side of the fastening mechanism 350 can be held by a hinged connection 388, 389. In some embodiments, a stiff wire inside the hemmed or molded top edge of the track can be exposed at the hinge site, and this exposed wire can operate as a hinge pin for the fastening mechanism straps. The barrel of the hinge can be formed at each end of the straps that connect to the fastener buckle and adjustable strap. The hinges allow for the straps on the fasteners to be spread wide apart for easy attachment and removal of the track assembly 300 to the ski.

Figure 6:
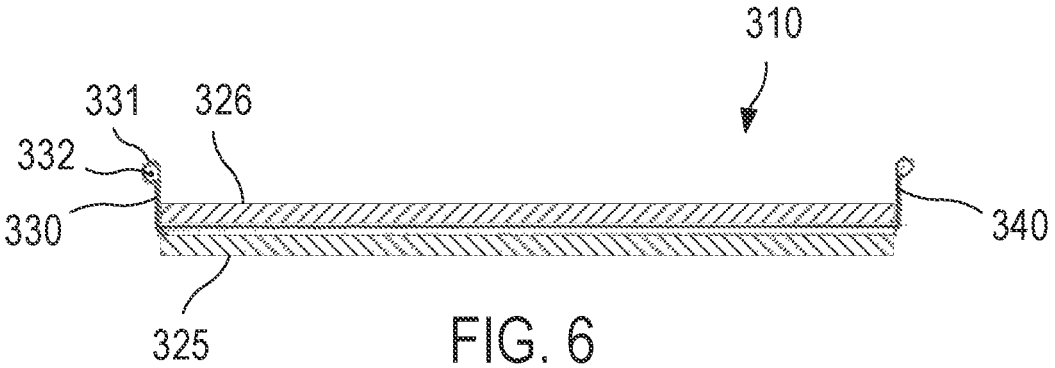
FIG. 6 illustrates aspects of a climbing track assembly of a ski climbing attachment system, according to embodiments of the present invention.

FIG. 6 provides a cross-section view of the base 310, according to some embodiments of the invention. A friction mechanism 325 affixed with the bottom of the base 310 or otherwise incorporated into the bottom of the base 310 can improve traction in the snow. In some cases, the friction mechanism 325 includes a slant-pile fabric, such as synthetic climbing skin material. In some cases, the friction mechanism 325 includes a plastic (e.g. P-tex or polyethylene) base material embossed with fish-scale pattern. As discussed elsewhere herein, in some cases a friction mechanism 325 can be adhered or crimped to the track base 310. In some cases, a climbing track assembly includes a padded mechanism 326, such as an insert, attached with or incorporated into an upper surface of the track base 310. A padded mechanism 326 can be dense yet compressible to protect the base and/or edges of the ski. In some cases, the padded mechanism 326 extends partially or fully up the interior surface or one or both sidewalls 330, 340. The sidewalls 330, 340 can operate to provide stiffness to the track base 310. The sidewalls can also operate to prevent the ski from being mis-aligned in the track base 310. In some cases, a top edge of a sidewall 330 includes a continuous metal wire with a rolled or molded hem 331 around it. The wire and hem can provide the track base 310 with additional stiffness. The wire can also operate as a hinge pin for a strap of a fastener mechanism.

In some cases, fastener arms or straps attach to the track base 310 where the sidewall rolled hem is notched just enough to expose the wire at the top of the sidewall. In some cases, fastener arm straps can operate to form a barrel of the hinge around the exposed wire of the track base. In some cases, hinges can enable fastener straps to be opened wide for easy attachment between the track base 310 and a ski. In some cases, fasteners or straps are positioned located approximately ⅓ back from leading edge 344 of the track base 310. In some cases, this positioning of the fasteners or straps can operate to ensure that the leading edge 344 of the track base 310 will be held firmly and snug against the upper surface of the ski, thus preventing snow from getting forced between the track base 310 and the base or lower surface of the ski when the user is moving forward through the snow or along the upper surface thereof. What is more, this positioning of the fasteners or straps can help to ensure that the track base 310 will be approximately centered under the skiers toe for maximum traction. In some embodiments, the fastener buckle and strap can be aligned over an included and integral under-binding bracket and then latched firmly to the ski, for example as shown in FIGS. 7-10.

Figure 7:
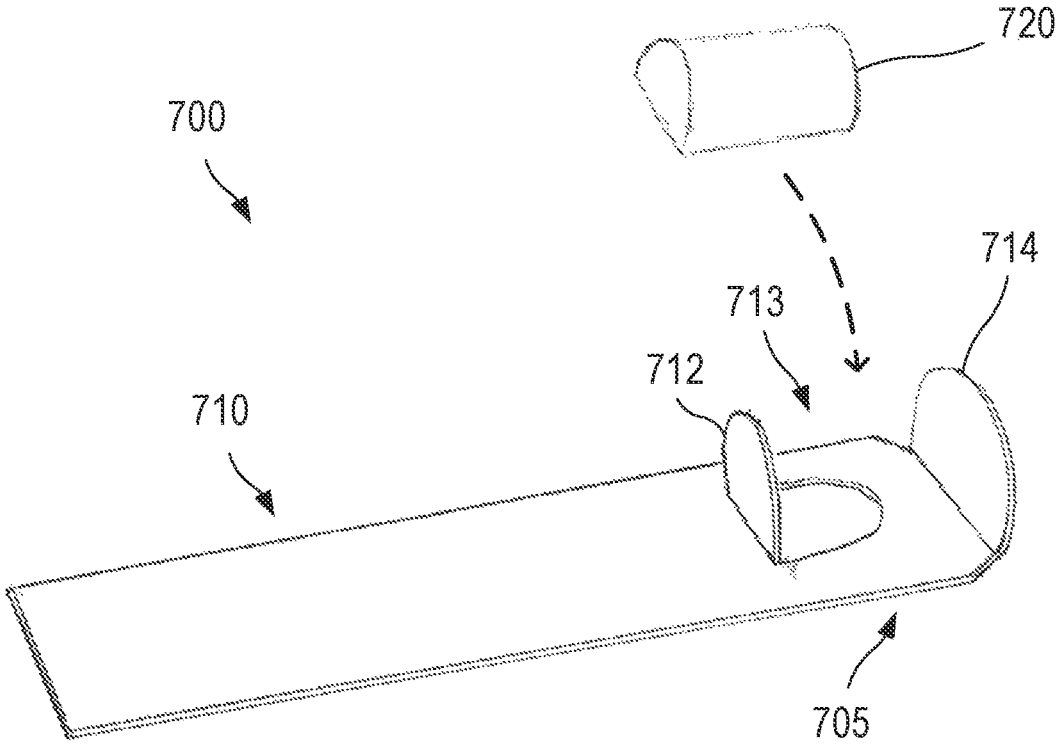
FIG. 7 illustrates aspects of an under-binding bracket assembly of a ski climbing attachment system, according to embodiments of the present invention.
Figure 8:
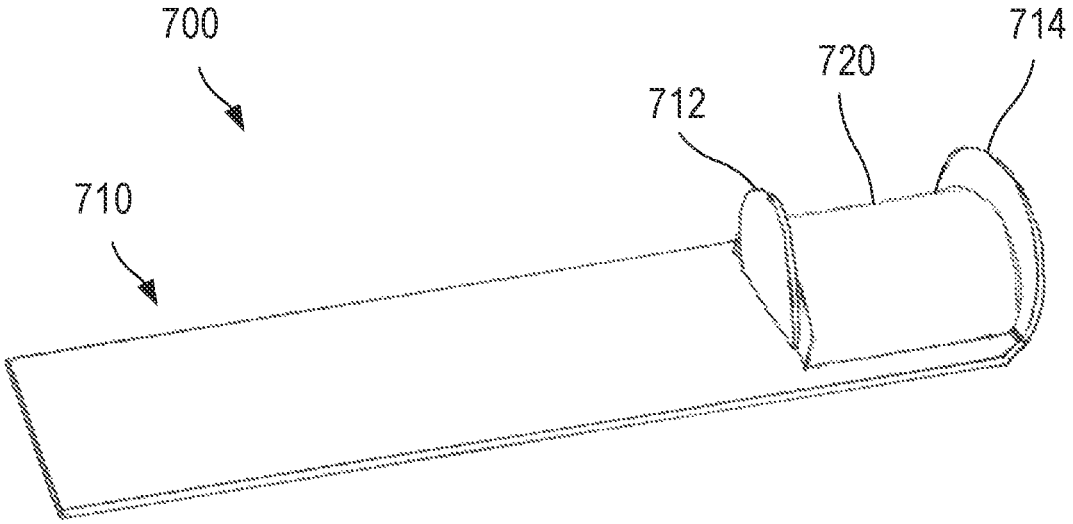
FIG. 8 illustrates aspects of an under-binding bracket assembly of a ski climbing attachment system, according to embodiments of the present invention.

A climbing track assembly can include an under-binding bracket assembly 700, as shown in FIG. 7. The under-binding bracket assembly 700 can include a bracket 710 and a riser block 720. As shown in FIGS. 7 and 8, the riser block 720 can be positioned between a first tab 712 and a second tab 714 of the bracket 710. In some embodiments, the under-binding bracket assembly 700 includes a lightweight metal plate 710 with two upturned tabs 712, 714 that form a channel 713 therebetween on a forward-facing or front area of the bracket. The channel 713 can be configured to receive the riser block 720. In some embodiments, the riser block 720 includes a firm yet compressible material that can be adhered in the channel 713 between the up-turned tabs 712, 714. As shown here, a bracket 710 can include a catch mechanism 705 configured to receive and/or cooperatively engage with a fastening mechanism. The catch mechanism 705 can include, for example, tabs 712, 714 and/or channel 713. In use, the catch mechanism 705 can operate to maintain the fastening mechanism in fixed positional relationship with the ski, particularly relative to the longitudinal axis or plane of the ski, as the user is hiking while wearing the ski. This cooperative engagement between the catch mechanism 705 and the fastening mechanism enhances the ability of the user to propel their body forward along a snowy surface, with their boot firmly secured with the ski, the ski firmly secured with the climbing track assembly, and the climbing track assembly firmly engaged with the snowy surface.

Figure 9:
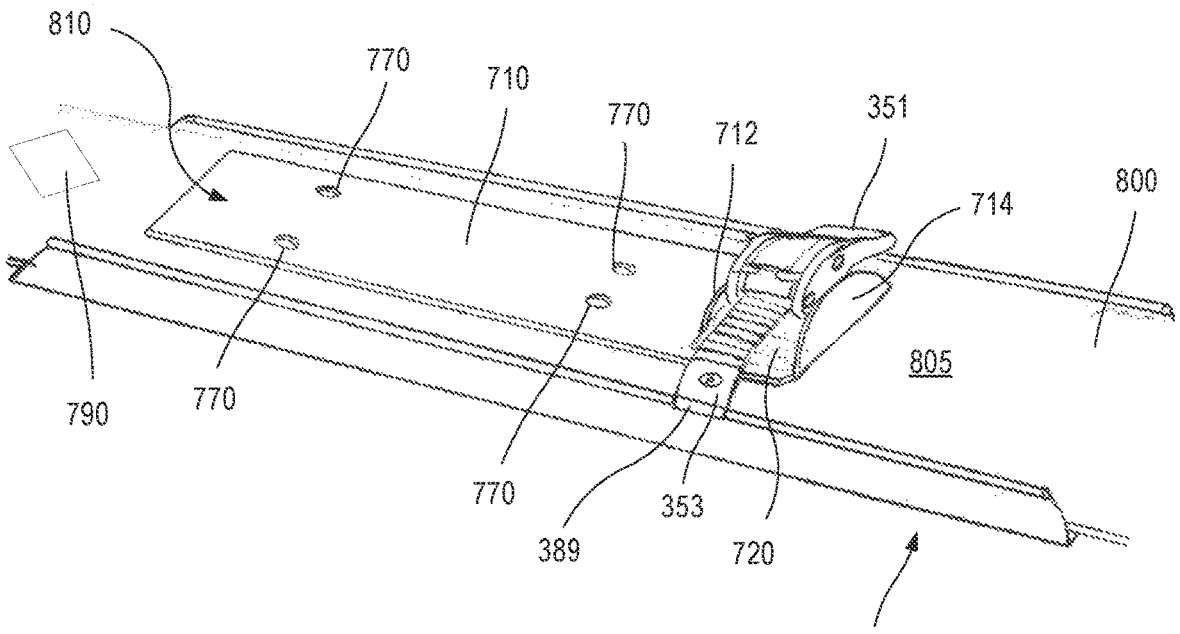
FIG. 9 illustrates aspects of a ski climbing attachment system, according to embodiments of the present invention.

As shown in FIG. 9, the under-binding bracket 710 can be mounted to a ski 800 (e.g. under the toe-piece binding of a ski and/or apposed to a top surface 805 of the ski) which can be secured to the base 310 of the climbing track assembly. In some cases, the bracket 710 can be mounted to the ski 800 using the mounting screw template pattern of the existing ski binding for attachment. For example, the bracket 710 can include holes or apertures 770 that match or correspond to the mounting screw template pattern of the ski binding. Advantageously, by using the existing mounting screw template pattern 810, there is no need to drill additional holes into the ski. This will be appreciated greatly by skiers and snowboard riders to not further weaken or allow another path for moisture to invade the integrity of their equipment. In some cases, bracket 710 is mounted beneath an existing ski binding.

In some cases, the climbing track assembly can include a small shim plate 790 that can be applied under the heel-piece where applicable (e.g. under an existing heel-piece), in order to keep the ski boot in a level plane. In some cases, the shim can be provided as a small lightweight metal plate, and can have a thickness that matches the thickness of the under-binding bracket 710. In some cases, the shim is mounted under the ski heel piece binding to maintain a level foot bed on the ski.

The fastener buckle 351 and adjustable strap 353 can be engaged together while they are aligned with the channel that is provided between tabs 712, 714. The fastener cam-style buckle 351 can be latched so that it will be captured by or positioned between the metal up-turned tabs 712, 714, and can firmly compress into the riser block 720. Advantageously, this alignment and firm attachment can operate to keep the climbing track 310 from slipping forward or rearward on the ski 800 while in use. Advantageously, the compressible riser block 720 can operate to allow for an easily adjustable, firm, and vibrational dampened attachment of the track 310 to the ski 800, even under jarring conditions.

In some embodiments, the under-binding bracket 710 can be mounted permanently to the ski (e.g. against an upper surface of the ski) and positioned under the ski toe-piece binding utilizing the existing ski binding screw template. Hence, it is possible that when mounting the bracket 710 to the ski 800 (e.g. coupling the bracket 710 with an upper or top surface 805 of the ski 800), no additional holes need to be drilled into the ski. The bracket 710 can be provided as a lightweight metal plate with upturned tabs 712, 714 forming a channel therebetween which receives fastener straps for alignment therein. The channel between the tabs 712, 714 can also operate to capture or receive at least a portion of the buckle 351 when aligned and latched to help ensure the track base 310 cannot move forward or back relative to the ski 800 while the user is hiking. The channel can be located immediately in front of the ski toe-piece binding. The positioning of the channel (optionally in conjunction with fastener strap location and/or track base length) can help to ensure that the approximate center of track base is centered under the skier's toe. The channel placement can allow a user to achieve friendly access for easy attachment and removal of fasteners. In some cases, the channel has a riser block 720 permanently adhered within it to aid in fastener attachment. In some cases, the riser block 720 can include a dense, compressible foam or equivalent material. In some cases, the riser block can operate to allow the fastener straps to compress when latched to form a more adjustable, firm, yet shock resistant attachment to the ski.

Figure 10:
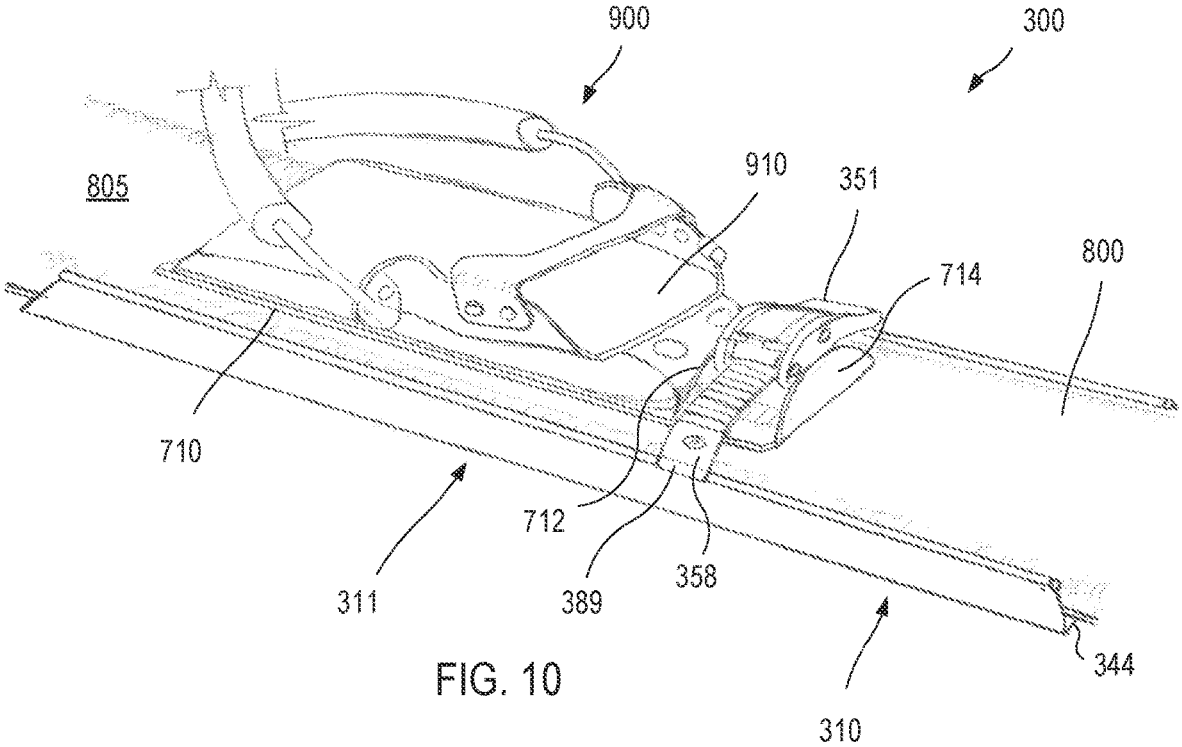
FIG. 10 illustrates aspects of a ski climbing attachment system, according to embodiments of the present invention.

As shown in FIG. 10, the under-binding bracket 710 can be mounted with the channel formed by the upturned tabs 712, 714 immediately in front of the toe-piece 910 of the ski binding 900, or as near as possible. This placement of the under-binding bracket 710 in conjunction with the location of the fastener straps on the track base 310, and the length of the track base 310 itself, can ensure that when the climbing track assembly 300 is attached to the ski 800, the center or a central portion 311 of the track base 310 will be virtually centered under the skiers toe, and therefore center of the skier's mass while hiking, thus maximizing traction. The fastener straps (e.g. straps 356, 358 depicted in FIG. 3) which are affixed with the track base 310 can be located approximately ⅓ of the way back from the front leading edge 344 of the track base 310. This can help to center the mass as described above, and can also help to ensure a tighter fit on the front leading edge of the track. Advantageously, this can help to prevent snow and ice from being forced between the ski 800 and the leading edge 344 of the track base 310 while moving forward.

The relative centering of the track base 310 on or under the toe of the user also allows for the track base 310 itself to be of a convenient length and weight to be easily carried in a small day-pack when not in use, or storage. Because the track base 310 is firmly held to the ski 800, and easy to install thereon and remove therefrom, it can be particularly advantageous to more extreme backcountry users to have tracks configured in longer lengths, and/or, with more aggressive traction improving material or a friction mechanism. Such traction improving materials or friction mechanisms can include, without limitation, slant-pile fabrics with longer, stiffer bristles, or other inlayed cleats, or plastic bases with more aggressive fish-scale patterns, with more vertical relief.

Advantageously, skiers do not need to remove their skis from their shoes or boots in order to attach or remove the climbing track base 310. The convenience of this feature is highly advantageous for the user. In some embodiments, in order to install the climbing track base 310, the skier simply places the track base 310 on the snow next to their ski 800 facing forward. The user can unlatch the fastener buckle 351 and spread the hinges open (e.g. hinges 388, 389 shown in FIG. 5). The user can then step onto the climbing track assembly 300, so that their shoe or boot is on the toe-piece 910, and slide the ski 800 to align the straps 356, 358 with the channel 713 in the binding bracket 710 which is disposed between or otherwise defined by tabs 712, 714. The user can then engage the adjustable strap 353 into the buckle 351 and latch the buckle 351 firmly. The user is then ready to hike. When the user is finished hiking and ready to remove the track base 310, the user can simply follow the above procedure in the reverse order. For example, the user can unlatch the buckle 351, open the hinges 388, 389, step off of the toe-piece 910, remove the base 310 from the ski 800, place the base 310 in their day pack, and proceed to their next destination.

The frame or base 310 of the device can include 24 gauge steel sheet metal or other types of material, including without limitation aluminum, plastic, reinforced fiberglass, and Kevlar. In some cases, the sides of the base 310 are formed up to add rigidity, and to capture the ski and keep it aligned in a linear orientation when hiking, especially on a side hill.

The material used can be durable and somewhat resistant against the forces of the buckle 351. In some embodiments, it is the buckle 351 that applies pressure to maintain adequate force against the ski base. This keeps snow from being wedged between the device and the ski when driving forward. The rigidity of the sides can also play a role in this attachment. When the buckle 351 is levered over, the sides of the base 310 can bend in slightly under pressure, and this can help to ensure a firm attachment. Hence, it may be helpful if the material of the base 310 is of adequate rigidity to resist these forces over time.

In some cases, the placement of the buckle 351 can be approximately ⅓ of the way back from the front of the track base 310. Advantageously, this positioning can help to ensure that the front edge 344 of the track base 310 is firmly held against the ski 800, while still maintaining adequate pressure at the back edge of the track base 310.

In some embodiments, the placement of the buckle 351 on the device, and the placement of the bracket 710 relative to the toe piece 910 on the ski 800 work together to accomplish multiple objectives. First, the track base 310 can be virtually centered under the toe of the ski boot. This can help to ensure maximum grip, with the user's center of mass positioned directly over the track base 310. Second, it is user-friendly. The skier needs only to reach down in front of the toe piece 910 to buckle or unbuckle the fastening mechanism and release the track base 310 from the ski or attach it therewith.

The buckle 351 can be provided in any of a variety of styles. For example, the buckle 351 can be a lever style buckle or a ratchet style buckle. Other buckle styles are encompassed by embodiments of the present invention. In exemplary embodiments, it allows firm enough pressure to hold the track base adequately against the ski.

In some cases, the bracket 710 that the buckle 351 is placed in while fastened can also provide important benefits. In some cases, the bracket 710 can help to hold the track base 310 from sliding forward or back relative to the ski 800 while in use. The act of hiking in skis applies pressures to slide the track base 310 forward or backwards relative to the ski 800, and the bracket 710 can help to hold the track base 310 firmly against the ski 800, thereby allowing the skier to move efficiently across the ground or snow. In some cases, the bracket 710 can be incorporated into a plate under the binding toe piece 910, allowing for the climbing track assembly 300 to be used without additional holes being drilled into the ski. Climbing track assemblies disclosed herein are well suited for use in cold temperatures, as compared to other existing solutions that rely on adhesives which may not perform well in cold or wet conditions.

When hiking uphill, the forward step is often important, and it applies pressure to attempt to slide the device forward on the ski. The bracket 710 and track base 310 with climbing skin material or fish scale ski material will perform this step effectively. This could be made more effective with more aggressive traction material applied to the track base 310. Forward traction is important in hiking uphill, however the movement of the ski forward with the least resistance in order to make another step is also important. This motion is known as the glide. Glide is an important part of the hiking motion. Too much resistance inhibits glide and causes extra effort and wastes energy. The climbing skin material or fish scale base material are utilized also for their glide properties. When hiking on level or downhill slopes, the pressures are to force the track base 310 in a backward direction on the ski. The bracket/buckle on the track base 310 hold these forces in check as well. The material or friction mechanism can include a one-way nap that allows forward motion of the ski and resists backward motion of the ski.

Figure 11:
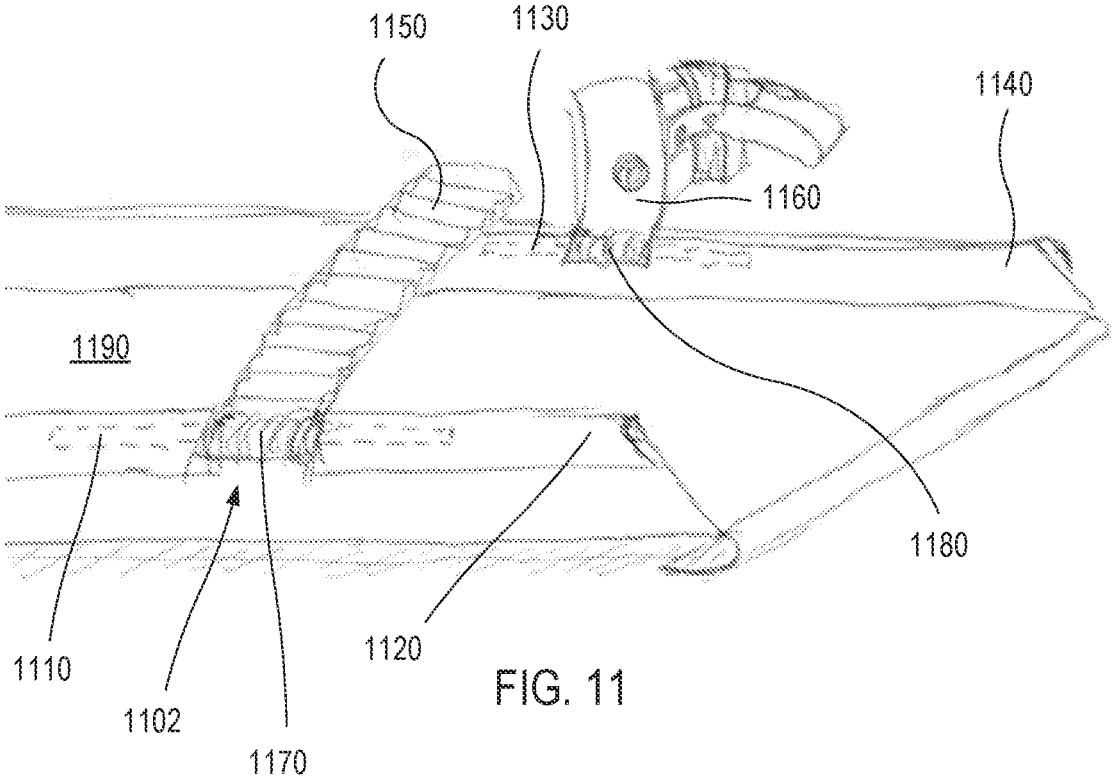
FIG. 11 illustrates aspects of a climbing track assembly of a ski climbing attachment system, according to embodiments of the present invention.

FIG. 11 depicts additional aspects of a climbing track assembly, according to some embodiments of the present invention. As shown here, a first wire 1110 can be disposed within a first hem 1120 and a second wire 1130 can be disposed within a second hem 1140. The hems may include cut-outs (e.g. cut-out 1102) where portions of the wire are exposed, and the exposed wire portions can be coupled with straps 1150, 1160 at hinged connections 1170, 1180, respectively. Wires may extend along a full length of a track base 1190, or along a portion thereof.

In some embodiments, devices may incorporate web strap material and/or web cam buckles. Other features may provide equal or greater effectiveness in actual hiking/skiing situations.

In some cases, a device may include one or more web straps instead of hinges, and an adjustable web strap "over center" buckle with the "catch" riveted to the web strap. In some cases, devices may include a web strap using a cam type strap buckle. It is desirable to provide an attachment mechanism that holds the strap tight enough and that does not slip when hiking. It is also desirable to provide a mechanism such as an adjustable over center buckle that confers sufficient leverage. Exemplary embodiments include a ladder strap/buckle. In some cases, devices include a skin material or fish scale base material attachment at the bottom of the device. In some cases, such skin material can be attached with the track base and the metal hemmed over it front, back, and along the sides. In some cases, the material can be secured via crimping. A lower hinge placement (e.g. pin and hinge) can allow the strap to be close to the ski. A notch can help promote such placement.

In some cases, devices can be manufactured by hemming them in the front and back. In some cases, devices are not hemmed on the sides. In exemplary devices, skin material remains adhered along the entire base of the device. The side hem may provide a cleaner appearance as well. In some embodiments, hinges are riveted to the sides.

Although embodiments of the present invention have been explained in relation to one or more preferred embodiments, it is to be understood that many other possible modifications and variations can be made without departing from the spirit and scope of the invention.

All features of the described systems and devices are applicable to the described methods mutatis mutandis, and vice versa. Embodiments of the present invention encompass kits having ski climbing attachment systems as disclosed herein. In some embodiments, the kit includes one or more systems for attaching with a ski or skis, along with instructions for using the system for example according to any of the methods disclosed herein.

Although the foregoing invention has been described in some detail by way of illustration and example for purposes of clarity of understanding, one of skill in the art will appreciate that certain changes, modifications, alternate constructions, and/or equivalents may be practiced or employed as desired, and within the scope of the appended claims. In addition, each reference provided herein in incorporated by reference in its entirety to the same extent as if each reference were individually incorporated by reference. Relatedly, all publications, patents, patent applications, journal articles, books, technical references, and the like mentioned in this specification are herein incorporated by reference to the same extent as if each individual publication, patent, patent application, journal article, book, technical reference, or the like was specifically and individually indicated to be incorporated by reference.

What is claimed is:

1. A ski climbing attachment system for coupling with a ski, the system comprising:

a climbing track assembly comprising a base and a fastening mechanism, wherein the base comprises an upper surface configured to engage a bottom surface of the ski, a right sidewall configured to engage a right side of the ski, a left sidewall configured to engage a left side of the ski, and a bottom surface comprising a friction mechanism configured to grip a snowy surface, and wherein the fastening mechanism is in pivoting engagement with the base; and an under-binding bracket assembly comprising a bracket and a catch mechanism, wherein the bracket is configured to be engaged with a top surface of the ski, and wherein the catch mechanism is configured to engage the fastening mechanism of the climbing track assembly.

2. The ski climbing attachment system according to claim 1, wherein the fastening mechanism comprises a first fastening member and a second fastening member, the first fastening member in pivoting engagement with the left side of the base and the second fastening member in pivoting engagement with the right side of the base.

3. The ski climbing attachment system according to claim 2, wherein the first fastening member is in pivoting engagement with the left side of the base via a first wire that is coupled with the left side of the base, and wherein the second fastening member is in pivoting engagement with the right side of the base via a second wire that is coupled with the right side of the base.

4. The ski climbing attachment system according to claim 2, wherein the first fastening member comprises a buckle, and wherein the second fastening member comprises a ladder strap.

5. The ski climbing attachment system according to claim 1, wherein the catch mechanism of the under-binding bracket assembly comprises a first tab and a second tab.

6. The ski climbing attachment system according to claim 5, wherein the first tab and the second tab define a channel therebetween, and wherein the channel is configured to receive the fastening mechanism of the climbing track assembly.

7. The ski climbing attachment system according to claim 1, wherein the under-binding bracket assembly further comprises a riser block configured to engage the fastening mechanism of the climbing track assembly.

8. The ski climbing attachment system according to claim 7, wherein the riser block comprises a compressible material.

9. The ski climbing attachment system according to claim 1, wherein the friction mechanism comprises a slant-fiber pile fabric.

10. The ski climbing attachment system according to claim 1, wherein the friction mechanism comprises an embossed one-directional pattern.

11. The ski climbing attachment system according to claim 10, wherein the embossed one-directional pattern comprises a fish scale pattern.

12. A method of engaging a ski climbing attachment system with a ski, the method comprising:

engaging a climbing track assembly with the ski, the climbing track assembly comprising a base and a fastening mechanism, wherein the base comprises an upper surface configured to engage a bottom surface of the ski, a right sidewall configured to engage a right side of the ski, a left sidewall configured to engage a left side of the ski, and a bottom surface comprising a friction mechanism configured to grip a snowy surface, and wherein the fastening mechanism is in pivoting engagement with the base; and engaging an under-binding bracket assembly with the ski, the under-binding bracket assembly comprising a bracket and a catch mechanism, wherein the bracket is configured to be engaged with a top surface of the ski, and wherein the catch mechanism is configured to engage the fastening mechanism of the climbing track assembly.

13. The method according to claim 12, wherein the fastening mechanism comprises a first fastening member and a second fastening member, the first fastening member in pivoting engagement with the left side of the base and the second fastening member in pivoting engagement with the right side of the base.

14. The method according to claim 13, wherein the first fastening member is in pivoting engagement with the left side of the base via a first wire that is coupled with the left side of the base, and wherein the second fastening member is in pivoting engagement with the right side of the base via a second wire that is coupled with the right side of the base.

15. The method according to claim 13, wherein the first fastening member comprises a buckle, and wherein the second fastening member comprises a ladder strap.

16. The method according to claim 12, wherein the catch mechanism of the under-binding bracket assembly comprises a first tab and a second tab.

17. The method according to claim 16, wherein the first tab and the second tab define a channel therebetween, and wherein the channel is configured to receive the fastening mechanism of the climbing track assembly.

18. The method according to claim 12, wherein the under-binding bracket assembly further comprises a riser block configured to engage the fastening mechanism of the climbing track assembly.

19. The method according to claim 18, wherein the riser block comprises a compressible material.

20. The method according to claim 12, wherein the friction mechanism comprises a slant-fiber pile fabric or an embossed one-directional pattern.

* * * * *